US006347486B1

(12) United States Patent
Badillet

(10) Patent No.: US 6,347,486 B1
(45) Date of Patent: Feb. 19, 2002

(54) APPARATUS FOR CONTROLLING THE OPENING OF A DOOR

(75) Inventor: Jean Badillet, Rueil-Malmaison (FR)

(73) Assignee: Unitechniques, Rungis (FR)

( * ) Notice: Subject to any disclaimer, the term of this patent is extended or adjusted under 35 U.S.C. 154(b) by 0 days.

(21) Appl. No.: 09/430,873

(22) Filed: Nov. 1, 1999

(30) Foreign Application Priority Data

Nov. 2, 1998 (FR) ..... 98-13723
Jan. 20, 1999 (FR) ..... 99-00565

(51) Int. Cl.[7] ..... E05B 65/06

(52) U.S. Cl. ..... 49/394; 49/504; 70/262; 70/264; 70/278.1

(58) Field of Search ..... 49/394, 504; 70/256, 70/257, 262, 263, 264, 278.1

(56) References Cited

U.S. PATENT DOCUMENTS 3,192,448 A * 6/1965 Hevenor ..... 70/278.1 X
5,321,963 A * 6/1994 Goldman ..... 49/394 X
5,670,940 A * 9/1997 Holcomb et al. ..... 70/262 X

FOREIGN PATENT DOCUMENTS

DE 196 25 237 A1 1/1998
DE 196 52 348 A1 6/1998
FR 2 654 143 A1 5/1991
FR 2 693 759 A1 1/1994
FR 2 721 648 A1 12/1995

OTHER PUBLICATIONS

International Publication No. WO 92/09773 of Int'l Application No. PCT/IT91/00100 published Jun. 11, 1992 (Antonello Luis Maria).
French Search Report of FA 567313 and FR 9900565 listing above–identified foreign patent documents.
Annex to French Search Report.

* cited by examiner

*Primary Examiner*—Jerry Redman
(74) *Attorney, Agent, or Firm*—Oppenheiner; Wolff & Donnelly LLP

(57) ABSTRACT

Apparatus for controlling the opening of a door that is held in its closed position in a partition by door-blocking. The apparatus comprises a section bar support of length at least substantially equal to the height of the door, and fixed to the door or to the partition in a position such that it has a first end located at one of the top and bottom ends of the door or of the partition. The support is fitted with power supply and with data transmission comprising at least two conductors which extend substantially to said first end so as to be connected to conductors situated in the vicinity of the end of the door or the partition at which said first end is located. The support is fitted with quick-fixing and with quick-connection for receiving one or more modules, and in particular a detection module for detecting door-opening control information, said module being suitable for connection to data transmission to transmit a control signal for controlling the door-blocking, which control signal is established as a function of the information detected by the detection module. In addition, the apparatus includes cover-forming in the form of a section bar and designed to cover the zones of the support in which no module is present.

14 Claims, 3 Drawing Sheets

FIG.2
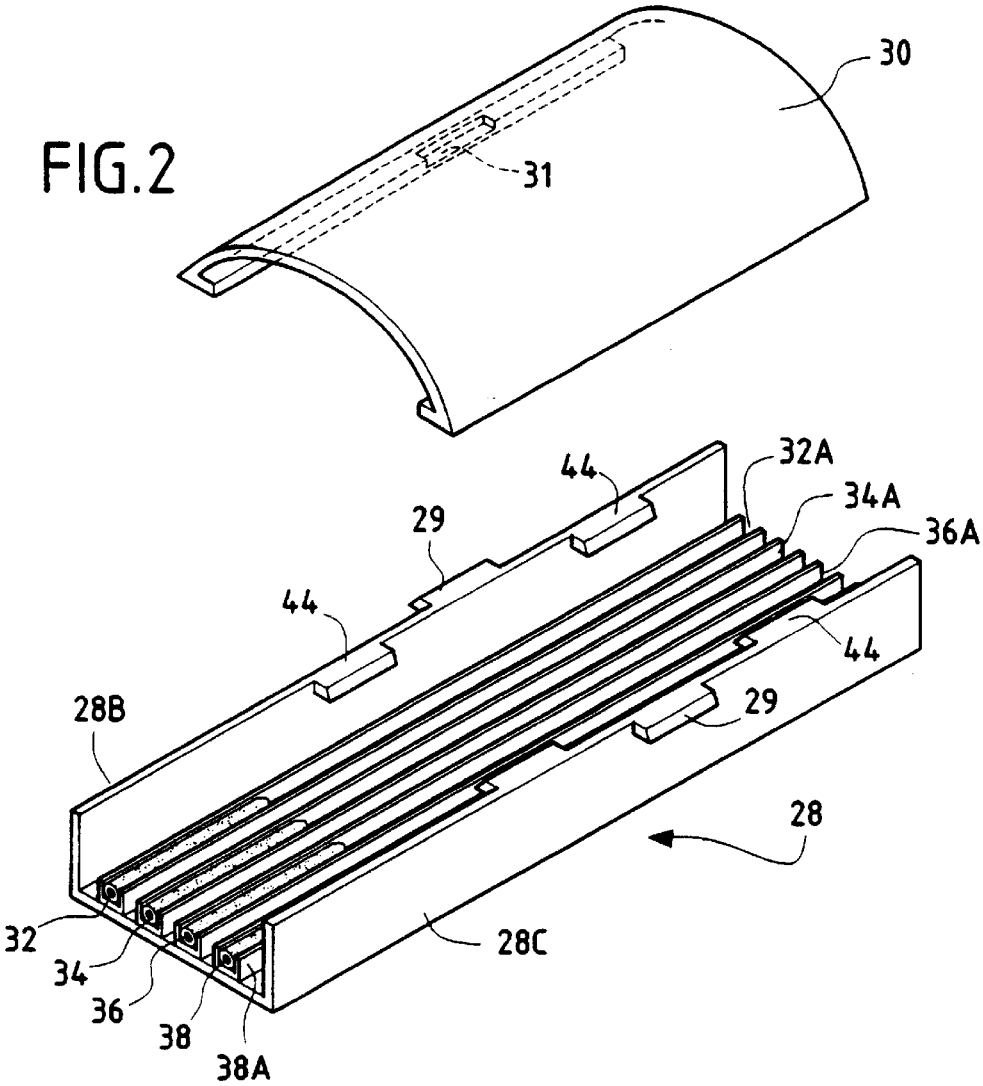
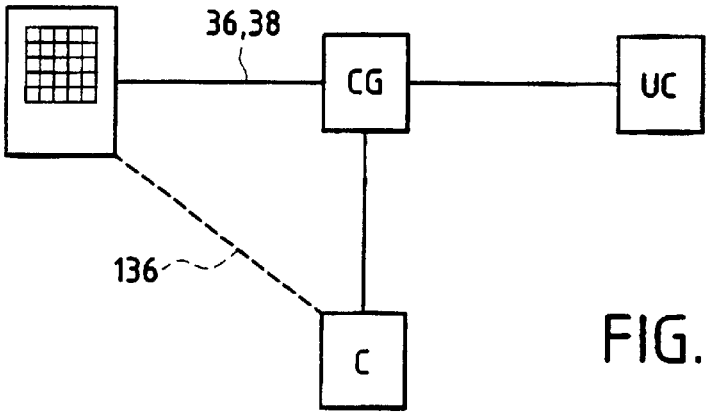
FIG.3

APPARATUS FOR CONTROLLING THE OPENING OF A DOOR

The present invention relates to apparatus for controlling the opening of a door in a partition, which door is suitable for being held in a closed position by blocking means, the apparatus including means for detecting door-opening control information and means for controlling the blocking means so as to allow or prevent door opening as a function of the information detected.

BACKGROUND OF THE INVENTION

Apparatus of that type is commonly used to limit access to certain premises, e.g. in offices. Such apparatus can be provided when the premises are built, or it can be installed in pre-existing premises on a door for which access was initially uncontrolled, or on a door that already has access control apparatus, but where the apparatus is to be replaced.

In any event, access control apparatus is generally installed in a building after it has been built. Even if installing such apparatus is part of the initial plan, it is still necessary during installation to fix the apparatus to the partition in the vicinity of the door, or on the door itself, and to bring control or power leads to the apparatus. Insofar as such leads ought preferably to be protected or to extend for the most part within the zone to which access is controlled, installing such apparatus constitutes an operation that is relatively expensive, since partitions need to be drilled so that the leads can be passed through, given that the leads extend for the most part on the rear faces of such partitions, i.e. inside the protected premises, and in a manner that is unsightly.

Known access control apparatus is itself unsightly, and for the most part it comprises a control panel installed against the door or the partition, forming a solid block which spoils the appearance and the ease of use of the door having controlled access.

OBJECTS AND SUMMARY OF THE INVENTION

An object of the present invention is to propose apparatus for controlling the opening of a door which is simpler to put into place, and which provides improved appearance and whose ease of use relating to the door and to its surroundings, in particular inside the zone where the apparatus is situated.

This object is achieved by the apparatus of the invention comprising:

a section bar support of a length at least substantially equal to the height of the door, said support being designed to be fixed on one of the elements constituted by the door and the partition in a position such that it presents a first end located at one of the top and bottom ends of said element;

the support being fitted with power supply means and data transmission means comprising at least two conductors which extend substantially to the first end of said support so as to be put into communication with conductors existing in the vicinity of the end of said element at which said first end is located when the door is in the closed state;

the support being fitted with quick-fixing means and quick-connection means enabling one or more modules to be fixed to the support and enabling them to be connected to said power supply means and data transmission means, said module(s) comprising a detection module in which the means for detecting door-opening control information are located, the quick-connection means of the detection module being suitable for connecting said module to data transmission means for transmitting a control signal established as a function of the information detected by said module to the means for controlling the door-blocking means; and the apparatus further including cover-forming means in the form of a section bar, designed to cover those zones of the support in which no module is present.

Thus, with the invention, the section bar support is used not only to support the module(s) for controlling access or providing various functions, but also for conveying the electrical power supply and/or data transmission conductors serving for controlling the apparatus. Insofar as the section bar support extends all the way to one of the top or bottom ends of the element on which it is mounted, it becomes simpler to put the conductors contained in the section bar into communication with conductors already fitted to the premises to be protected.

In particular, most contemporary or renovated premises have leads for connection to power supply mains or cables for data transmission networks that are integrated either in false ceilings or in base boards or "skirting" boards.

In a first advantageous variant, the support is designed to be fixed to the partition in the vicinity of the door and the fact that it extends all the way to the bottom and/or top end of said partition makes it possible for the conductors carried by said support to be connected in discreet and protected manner to the pre-existing cabling of the building.

In a second advantageous variant, the support is designed to be fixed to the door. In this case, the connection to the cabling that pre-exists in the building is likewise discreet and protected. The cabling can be disposed in such a manner as to underlie the bottom end of the door when the door is closed. The cabling can also be disposed in such a manner as to come into the immediate vicinity of the door when the door is closed, for example it can be disposed in a section bar support placed in line with the support of the invention when the door is closed.

The conductors can be put into communication by contact. Thus, the cabling fitted to the building can extend as far as a contact zone situated on a standing portion (floor or doorframe) that is to be found in the immediate vicinity of a contact end (top end or bottom end) of the support when the door is closed. In this case, the contact end is provided with first contact means that are suitable, when the door is closed, for co-operating with second contact means fitted to said contact zone. For example, the first contact means may comprise a series of ball contacts, while the second contact means comprise fixed contact areas.

This makes it possible, at least when the door is closed, to establish connections between the power supply means and the data transmission means with cabling that already exists in the building.

It is also possible to envisage establishing such communication without making contact, by electromagnetic induction. Thus, in this variant, the support is fitted with a first electromagnetic coil situated at its first end and designed to be fed by electromagnetic induction from a second electromagnetic coil that is electrically powered and that is disposed in such a manner as to be in the vicinity of said first coil, at least when the door is in the closed state.

For a support that is designed to be fixed on the opening portion of the door, this variant advantageously replaces the above-mentioned contact means. Transfer by induction can be used not only for supplying power, but also for transmitting data.

The apparatus is made easier to install by the fact that the module(s) is/are put into place by quick-fixing means and by quick-connection means that already exist on the support. In particular, fixing can rely on snap-fastening or clipping, possibly associated with safety screws, while connection can be pluggable or the like.

Finally, the cover-forming means in the form of a section bar protect the apparatus as a whole in the zones outside the modules and make the apparatus pleasing in appearance.

In this respect, it should be observed that insofar as the apparatus extends over a considerable length, at least substantially of the same order as the height of the door which is about two meters, it is possible for it to be given a relatively flat shape, thereby eliminating the drawbacks associated with the fact that prior art control panels form solid blocks that project considerably.

Advantageously, the power supply means and the data transmission means include data transmission conductors which extend substantially to the first end of the support to be connected to a data transmission network having connection lines that are to be found in the vicinity of the end of the door or of the partition at which said first end of the support is located or to which said first end is adjacent when the door is in the closed state.

Advantageously, the support has determined zones specially designed to receive such-and-such a type of module, and said zones are fitted with keying means enabling only the module that is intended for any given zone to be connected thereto.

BRIEF DESCRIPTION OF THE DRAWINGS

The invention will be well understood and its advantages will appear more clearly on reading the following detailed description of an embodiment given by way of example. The description refers to the accompanying drawings, in which:

FIG. 2 is a diagrammatic perspective view showing the section bar support and its cover;

FIG. 3 is a block diagram of a control circuit associated to the apparatus of the invention.

MORE DETAILED DESCRIPTION

Figure 1:
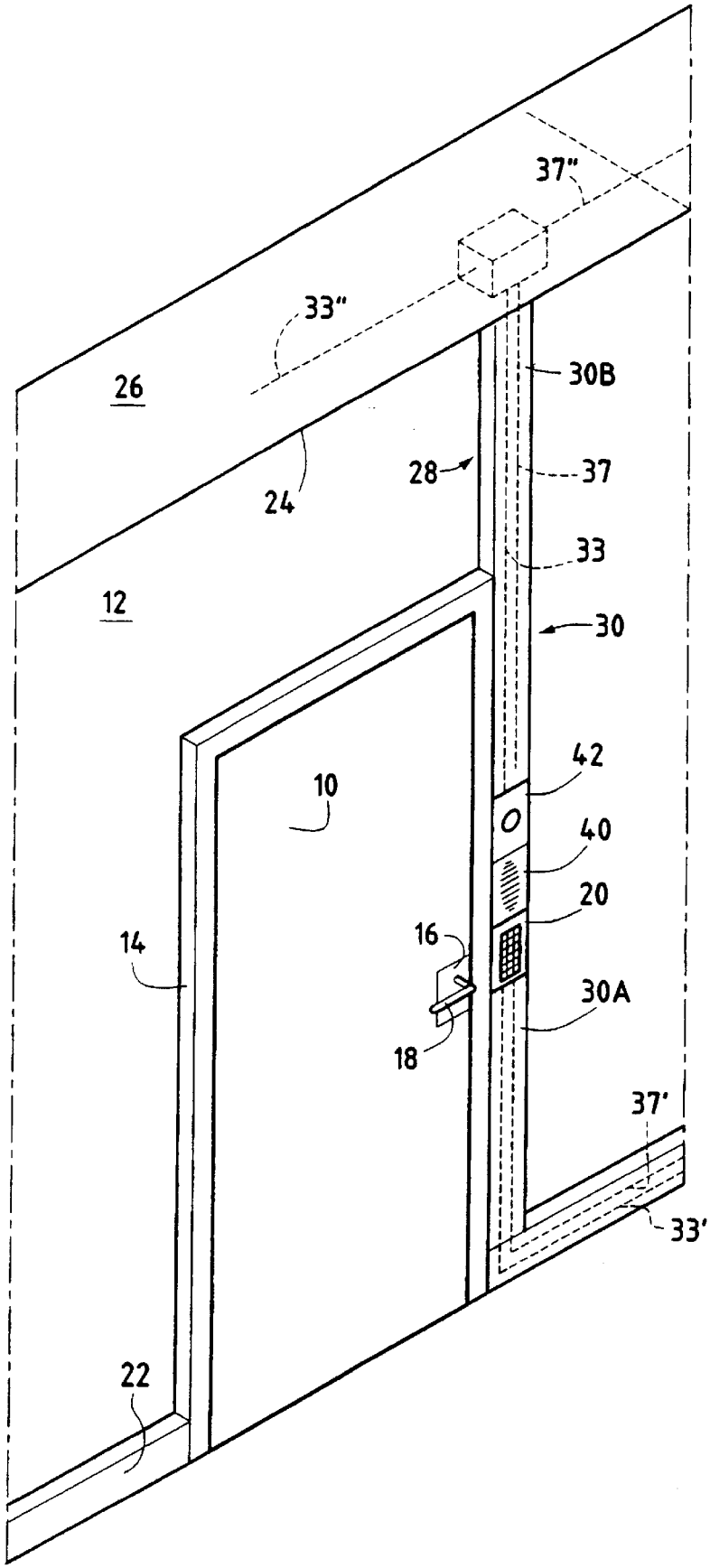
FIG. 1 is a perspective view of the surroundings of a door fitted with access control apparatus of the invention.

FIG. 1 shows a door 10 fitted in a partition 12. The door 10 and its jamb 14 are fitted with a lock, with only an external portion fitted to the door being shown diagrammatically in FIG. 1 where it is referenced 16, the lock being controllable to open or close the door. The lock can be fitted with a handle 18 which, when access to the premises protected by said door is authorized, can be actuated to open the door. Conventionally, the lock has a bolt secured to the door while the jamb has a striker plate with which the bolt can co-operate. The portion of the lock that is secured to the jamb 14 has a striker plate that can be fixed or that can have a moving element.

Thus, the fact that access is authorized can give rise to the release of means for blocking a moving bolt, thereby allowing the door to be opened merely by being pushed against. It may also give rise to the release of bolt-blocking means enabling the bolt to be actuated by pushing against the door or by turning the handle 18.

The means for blocking the door while it is in the closed position can be of a type other than said lock. For example, it can be a system of the electromagnetic type (electromagnetic succion cup), or it can be a controlled door-closer, preferably situated on the side of the door that is inside the premises to which access is to be controlled. Under such circumstances, when door opening information is recognized, then said blocking means are controlled in such a manner as to release the blocking of the door and thus enable it to be opened, e.g. by means of the above-mentioned handle.

The access control apparatus has means for detecting door-opening control information. This information can be obtained, for example, by inputting a code via a keypad, by reading magnetic tracks on a card slipped into a reader or placed close to a proximity reader, or by any other known means for reading or inputting information. Thus, in addition to code-based or card-based systems, the means for detecting door opening control information can include a sensor for picking up biometric parameters (fingerprints, voice prints, eye prints) associated with a memory zone in the apparatus where the biometric parameters of one or more authorized users are stored.

In the example of FIG. 1, the modules for detecting door opening control information is constituted by the module 20 which is fitted with a keypad enabling a code to be input.

The module 20 is integrated in an elongate element which extends over the full height of the partition 12 from the skirting board 22 to the top end 24 of the partition above which there is a false ceiling 26.

With reference to FIG. 2, it will be understood that this elongate element includes a section bar support 28 of length substantially equal to the height of the partition 12, said section bar being, for example, in the form of a generally channel-section rail whose web 28A is designed to be placed against the partition 12 while the flanges 28B and 28C of the channel section are suitable for co-operating with a cover 30 which is itself also in the form of a section bar.

According to the invention, one of the ends of the support is connected, either its end at the bottom of the partition 12 (skirting board 22), or else its top end 24. The support can be selected to have substantially the same height as the door (possibly minus the height of the skirting board) so that it extends from the skirting board over the full height of the jamb, thus making it appear somewhat as part of the door jamb. It is also possible to chose to have a support that extends up the full height of the partition, as in the example shown.

In addition to the support 28 in the form of a rectilinear section bar, the apparatus of the invention can have one or more additional section bar supports, with the set of supports being fitted around two or more faces of the doorframe.

In FIG. 2, it can be seen that the support carries conductors for power supply and for data transmission. In the example shown, two power supply conductors 32 and 34, and two data transmission conductors 36 and 38 are disposed in respective rails 32A, 34A, 36A, and 38A, which are insulated from one another. By way of example, the rails are disposed against the web 28A of the support. In FIG. 1, the presence of these conductors is represented diagrammatically by fine dashed lines, respectively referenced 33 for the power supply conductors and 37 for the data transmission conductors.

According to the invention, because the support extends to an end of the partition, it is possible to put these conductors 33 and 37 into communication with pre-existing conductors in the building, e.g. conductors 33' and 37' housed in the skirting boards 22 or conductors 33" and 37"

housed in the false ceiling. Naturally, it can also happen that the power supply conductors are housed in the skirting board while the data transmission conductors are housed in the false ceiling. In general, since the support has a first end extending to the vicinity of one of the partition, at least two conductors extend substantially to said first end so as to be put into communication with conductors (electrical power supply and/or data transmission conductors) that are situated in the vicinity of said end of the partition.

This communication can take place by contactless means, using electromagnetic induction.

The support 28 can be fixed to the partition by means of its web 28A, e.g. by screws. The support is fitted with quick-fixing means and with quick-connection means for the module(s) of the apparatus. In FIG. 1, there can be seen the module 20 which is used for detecting door-opening control information, but above the module 20 there can also be seen a module 40, e.g. constituted by an interphone or by a proximity reader for a magnetic badge, and also a camera module 42.

Other modules can be provided, for example a module including a call button, and a display module (displaying certain items of information such as date, time, temperature, room number of the protected room in a building, name and position of the person occupying the room, . . . ). The display module can constitute a service notice module displaying or issuing information that is input depending on requirements (for example a message to the effect that the occupier of the protected room is temporarily absent), or information controlled by a central unit to which the module is connected via a network (for example if a building is fitted with a plurality of access control apparatuses managed over a single network, then their service notice modules can receive orders to issue a search message or a rendezvous message when the presence of the person being looked for or expected at a meeting is detected by the information detection means of any one of the apparatuses because that person is using a badge, a personal code, etc., to request access to the space controlled by the apparatus).

The support can also include a coil, e.g. in the form of a wire embedded in the plastics material of said support and extending along its full height. It can be a coil for a purely magnetic field or an antenna for an electromagnetic field. The coil can take advantage of the long length of the section bar to generate a field of relatively long range covering the full height of the door. It is associated with a proximity reader.

In this respect, the apparatus can include a proximity detection system for detecting objects that gives the apparatus of the invention the additional function of acting as an object-detector gate, for example a gate for detecting objects fitted with an electronic tag system.

This detection system can signal or even prevent particular objects entering or leaving or it can allow such objects to enter or leave only with a given person recognized by any appropriate means such as a badge, a code being input, a biometric parameter, . . . . Under such circumstances, dialog can be organized between the object detector system and the means for detecting door-opening control information.

When the means for detecting door-opening information include a proximity detector, the object detector system is advantageously associated with said detector, being integrated therewith or being in the form of a separate module.

It should be observed that the conductors are shown in a manner that is entirely diagrammatic. In general, it should be assumed that at least two conductors are present, and that they extend substantially all the way to the end of the support that is located at an end of the element to which the support is fixed, i.e. of the partition (via its skirting board or false ceiling) or of the door. For example, there may be two power supply conductors: neutral and live; together with two data transmission conductors. Alternatively, a neutral conductor can be provided which, in association with a live conductor serves to supply electrical power, and in association with a signal modulation conductor serves to carry data. It is also possible to have only two conductors: one neutral and one live; with means for modulating a voltage signal on the live conductor for the purpose of carrying data. Thus, the support 28 has at least two conductors, e.g. formed or placed in rails formed as part of the support or fitted thereto.

Advantageously, the quick-connection means include means for engaging the module(s) concerned in the rails. For example, the rear faces of the modules can be fitted with electrically-conductive jacks disposed in such a manner as to engage in the rails in a determined order.

As mentioned above, the module fixing means can comprise clip means or snap-fastening means. Thus, FIG. 2 shows that the flanges 22B and 22C of the support can be fitted with snap-fastening means 44 (e.g. tabs) suitable for co-operating with complementary snap-fastening means fitted to the modules (e.g. recesses).

Advantageously, the support 28 has determined zones specifically designed to receive such-and-such a type of module. For example, it is desirable that the detector module 20 which operates by means of a code should be situated at hand height, while the camera module 42 should be situated higher up. Advantageously, these zones are fitted with keying means that make it possible to connect only the appropriate module in any particular zone. The keying means can be implemented quite simply on the means for fixing the modules relative to the support, e.g. by giving appropriate shapes to the above-mentioned snap-fastening means.

When the support is to receive a plurality of modules, the apparatus advantageously includes means for organizing dialog between the modules via data transmission conductors belonging to the power supply means and the data transmission means. Dialog can be organized in such a manner that one module has priority over another, e.g. enabling certain authorized people to gain access to the protected premises by means of a badge or a remote control without keying-in the code, in which case the module capable of reading the badge or of receiving the remote control message takes priority over the module for reading the code. It is also possible to take steps so that after a plurality of unsuccessful attempts on the detector module, e.g. the code reader module, it sends a message to an alarm module with which the apparatus is also fitted. Advantageously, the various modules perform dialog using a protocol that is compatible with the data transmission lines of the pre-existing network.

The cover 30 of the apparatus is constituted by one or more segments of section bar adapted to cover the section bar of the support 28. In general, it is necessary to provide a bottom segment 30A between the skirting board 22 or the bottom of the door and the bottom module 20, and a top segment 30B above the top module. If a plurality of modules are present, they are advantageously located immediately one above another up the support.

In FIG. 2, it can be seen that the section bars of the cover 30 can be fixed to the support 28 by fixing means that are simple, e.g. by snap-fastening. The support has first fixing means (snap-fastening projections 29) and the section bar of the cover has matching second fixing means (snap-fastening recesses 31).

FIG. 3 is an extremely simplified block diagram showing typical operation of the apparatus. By way of example, the module 20 is represented by a code-receiving box, which communicates with an electronic control card CG, e.g. via data transmission conductors such as the above-mentioned conductors 36 and 38. This electronic control card is capable of reading the signal obtained by the code input to the keypad, and of comparing it with an authorization signal (which may be updated periodically), and which is transmitted thereto by a central control unit UC. If the comparison shows that the signal is correct, then the electronic control card can issue a door-opening order to release the means for blocking the door, as represented by reference C.

It is also possible to imagine another system in which the detection module includes a "correct" encoded signal in its own memory and in which inputting the correct code gives rise directly to a control pulse or signal being applied to the door-blocking system (e.g. a moving bolt) over the dashed line 136 shown in FIG. 3.

Naturally, these particular ways of operating are given purely as examples. It is possible for data to be transmitted between the detection module and a control system such as an electronic control card over conductors such as 36 and 38, while the signal between said control system and the door-blocking means takes place some other way, e.g. by means of a radio signal or an infrared signal.

Figure 4:
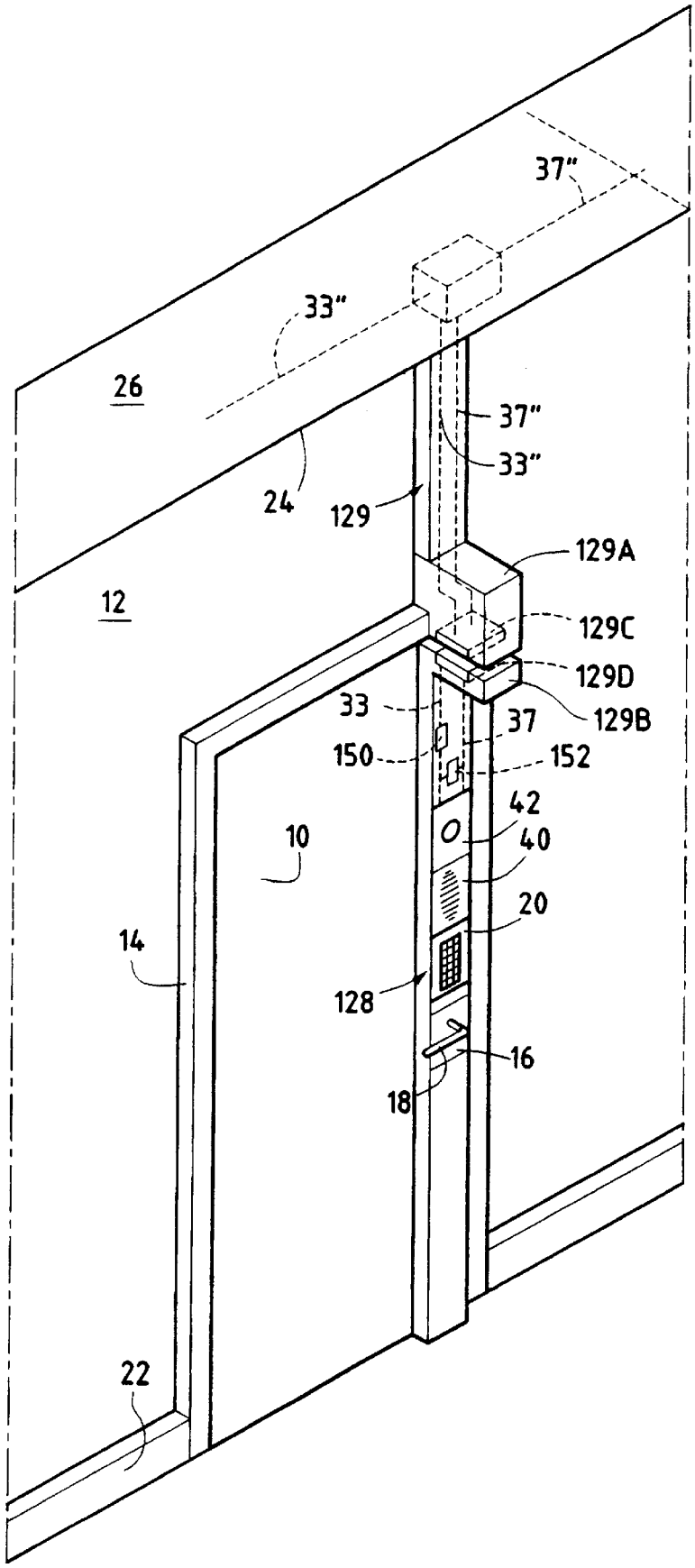
FIG. 4 is a view analogous to FIG. 1 showing the variant in which the support of the access control apparatus is placed on a door.

In the variant of FIG. 4, the support 128 of the access control apparatus is fixed on the door 10. The lock 16 is disposed in a central region of the support, with the cover thereof optionally being in two portions extending on either side of the lock. Apart from special dispositions for housing the lock in the support, the support is analogous to the support 28 of FIG. 1 and has modules 20, 40, and 42.

In the example shown, the conductors of the support are connected to pre-existing cabling in the building via the top end of the support which is situated at the top end of the door.

More precisely, the cabling 33" and 37" that is already in existence in the false ceiling is brought down to the door-frame in a guide 129 which is possibly in the form of a section bar having substantially the same outside appearance as the support 128 together with its cover, and extending above the door in line with the position occupied by the support 128 when the door is closed. The cabling 33" and 37" is thus brought to a box 129A while the top end of the support 128 is fitted with a box 129B which is to be found immediately below the box 129A when the door is closed. These boxes 129A and 129B are fitted with respective first and second contact means 129C and 129D which establish contact between the cabling 33" and 37" and the conductors 33 and 37 of the support 28 when the door is shut. Advantageously, automatic circuit breaking or isolation means are provided so as to isolate the contact means 129C from their supply means when the door is open, so as to avoid any unwanted electrical contact.

The contact means 129C and 129D can be replaced by the above-mentioned first and second electromagnetic coils.

To clarify the drawing, the dimensions of the boxes 129A and 129B are exaggerated. These boxes can be flat and differ little or not at all in visual appearance from the section bars 128 and 129.

Advantageously, the apparatus of the invention has backed-up power supply means so as to ensure that the module(s) it contains continue(s) to be powered when the door is opened. These back-up means can be constituted by a battery or a rechargeable battery 150 controlled to deliver back-up power to the various modules when the main power supply ceases because the door is open.

When the back-up power supply means are rechargeable, the apparatus advantageously includes means for recharging them when the door is closed and the main power supply is reestablished.

The apparatus also advantageously includes a buffer memory 152 in which the data picked up by the various modules or associated with them when the door is open is stored temporarily, with the data subsequently being transmitted to the central control unit when the door is closed and the connection to the data transmission means is re-established.

The apparatus mounted on the door can also be fitted with a self-contained power supply such as a long duration battery, so as to power it regardless of the open or closed position of the door.

The example shown in FIG. 4 shows the support placed in a region of the door that is remote from its hinge. It would also be possible to provide for the apparatus to be situated in a region that is closer to the hinge, in which case the connection with the power supply means and the data transmission means could be obtained on a continuous basis, regardless of whether the door is open or closed.

In some cases, it is preferable for certain "vital" portions of the apparatus of the invention to be situated in the protected zone, i.e. on the inside of the premises to which access is controlled. Under such circumstances, the apparatus comprises a first support which is situated on the inside of the partition or of the door and which has the various systems for connection to the power supply means and the data transmission means. On the outside of the door or of the partition, the apparatus has a second support, optionally of elongate shape generally analogous to that of the first support, the second support supporting the interactive modules, in particular modules such as the module for detecting information concerning a request to open the door, the interphone, a camera, etc. The outside apparatus thus receives outside information such as, in particular, a request to open the door, and it transmits this information to the inside module which is itself protected from the outside.

The inside apparatus can also have one or more modules. Thus, it can have a camera or other means, and a module for requesting exit from the premises which, on mere request, enables the door to be opened quickly so as to allow people in the premises to leave it. This exit request module can include a pushbutton or a touch-sensitive knob. It can also be constituted by a module for detecting touch, having a relatively large contact zone, e.g. extending over a large portion of the cover of the support on said apparatus inside the premises.

As mentioned above, various possibilities can be envisaged for transmitting information, e.g. wire conductors, infrared links, radio links, etc. Under such circumstances, it is possible to make provision for it to be easy to transform the apparatus of the invention so as to enable it to be adapted to one or other of these methods of transmission, by ensuring that the data transmission means with which the apparatus is fitted terminate in a link box which a qualified operator can exchange so as to adapt the apparatus to the various different modes of transmission. The link box could possibly be fitted with a sensor for picking up radio waves, infrared waves, etc.

What is claimed is:

1. A door opening control apparatus, the apparatus comprising:

means for detecting door-opening control information of a door of a given height in a partition;

means for controlling a blocking means for holding the door in a closed position so as to allow or prevent the door opening as a function of the door-opening control information detected;

a section bar support of a length at least substantially equal to the height of the door, said support being designed to be fixed on an element of a plurality of elements constituted by the door and a partition in a position such that it presents a first end located at one of top and bottom ends of said element;

wherein the support is fitted with power supply means and data transmission means comprising at least two conductors which extend substantially to the first end of said support so as to be put into communication with conductors existing in a vicinity of an end of said element at which said first end is located;

wherein the support is fitted with quick-fixing means and quick-connection means enabling one or more modules to be fixed to the support and enabling them to be connected to said power supply means and data transmission means, said one or more modules comprising a detection module in which the means for detecting door-opening control information are located, the quick-connection means of the detection module being suitable for connecting said detection module to data transmission means for transmitting a control signal established as a function of the door opening control information detected by said detection module to the means for controlling the door-blocking means;

and wherein the apparatus further includes cover-forming means in a form of a section bar, designed to cover those zones of the support in which no module is present.

2. Apparatus according to claim 1, wherein the power supply means and the data transmission means include data transmission conductors which extend substantially to the first end of the support to be connected to a data transmission network having connection lines that are to be found in a vicinity of an end of the door or of a partition at which said first end of the support is located.

3. Apparatus according to claim 1, wherein the conductors of the power supply means and the data transmission means are disposed in mutually insulated rails.

4. Apparatus according to claim 3, wherein the support carries four conductors, two power supply conductors and two data transmission conductors, disposed in mutually insulated rails.

5. Apparatus according to claim 3, wherein the quick-connection means include means for engaging the rails.

6. Apparatus according to claim 1, wherein the support has determined zones specially designed to receive a module, and wherein said zones are fitted with keying means enabling only a module that is intended for any given zone to be connected thereto.

7. Apparatus according to claim 1, in which the support is designed to receive a plurality of modules, wherein the apparatus includes means for organizing dialog between the modules via data transmission conductors.

8. Apparatus according to claim 1, including, in addition to the detecting module, at least one auxiliary module such as a camera module, an interphone module, or an object detection module.

9. Apparatus according to claim 1, wherein the support is in a form of a rail of substantially channel section, whose web is designed to be placed against the element, and wherein the section bar cover-forming means comprise at least one section bar suitable for covering the support by being fixed thereto via the flanges of its channel section.

10. Apparatus according to claim 1, wherein the support is designed to be fixed on a door and wherein the support has a contact end fitted with first contact means suitable for co-operating with second contact means fitted to a contact zone located in a vicinity of the contact end of the support, at least when the door is in the closed position.

11. Apparatus according to claim 10, including backed-up power supply means designed to power the one or more modules of the apparatus when the door is in an open position.

12. Apparatus according to claim 11, including: a buffer memory in which data picked up by the one or more modules is stored temporarily when the door is in the open position, and means for transmitting said data to a central unit when the door is in the closed position.

13. Apparatus according to claim 1, wherein the support is fitted with a first electromagnetic coil situated at its first end and designed to be powered by electromagnetic induction from a second coil, itself electrically powered and located in such a manner as to be in a vicinity of said first coil at least when the door is in the closed position.

14. Door opening apparatus, the apparatus comprising:

means for detecting door-opening control information of a door of a given height in a partition;

means for controlling a blocking means for holding the door in a closed position so as to allow or prevent the door opening as a function of the door-opening control information detected;

a section bar support of a length at least substantially equal to the height of the door, said support being designed to be fixed on one of the door and a partition in a position such that it presents a first end located at one of top and bottom ends of said support;

wherein the support is fitted with power supply means and data transmission means comprising at least two conductors which extend substantially to the first end of said support so as to be put into communication with conductors existing in a vicinity of said one of top and bottom ends at which said first end is located;

wherein the support is fitted with quick-fixing means and quick-connection means enabling one or more modules to be fixed to the support and enabling them to be connected to said power supply means and data transmission means, said one or more modules comprising a detection module in which the means for detecting door-opening control information are located, the quick-connection means of the detection module being suitable for connecting said detection module to data transmission means for transmitting a control signal established as a function of the door opening control information detected by said detection module to the means for controlling the door-blocking means.

* * * * *